US009956791B2

(12) United States Patent
Samoto et al.

(10) Patent No.: US 9,956,791 B2
(45) **Date of Patent: *May 1, 2018**

(54) RECORDING APPARATUS

(71) Applicant: BROTHER KOGYO KABUSHIKI KAISHA, Nagoya-shi, Aichi-ken (JP)

(72) Inventors: Kenji Samoto, Nagoya (JP); Yusuke Arai, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/436,546

(22) Filed: Feb. 17, 2017

(65) Prior Publication Data

US 2017/0157952 A1 Jun. 8, 2017

Related U.S. Application Data

(63) Continuation of application No. 15/016,687, filed on Feb. 5, 2016, now Pat. No. 9,573,396, which is a (Continued)

(30) Foreign Application Priority Data

Mar. 31, 2014 (JP) ..... 2014-072720

(51) Int. Cl.
*B41J 29/393* (2006.01)
*B41J 11/00* (2006.01)
*B41J 2/01* (2006.01)

(52) U.S. Cl.
CPC ..... *B41J 11/006* (2013.01); *B41J 2/01* (2013.01)

(58) Field of Classification Search
CPC . B41J 2/01; B41J 11/006; B41J 29/393; B41J 11/0095; B41J 13/0009
See application file for complete search history.

(56) References Cited

U.S. PATENT DOCUMENTS 8,469,482 B2 6/2013 Pawlik et al.
8,733,884 B2 5/2014 Rzadca et al.
(Continued)

FOREIGN PATENT DOCUMENTS

JP 2001-113806 A 4/2001
JP 2004-90316 A 3/2004
(Continued)

OTHER PUBLICATIONS

Notice of Reasons for Rejection from corresponding Japanese Patent Application No. 2014-072720, dated Dec. 20, 2016.

*Primary Examiner* — Lamson Nguyen
(74) *Attorney, Agent, or Firm* — Merchant & Gould P.C.

(57) ABSTRACT

A recording apparatus includes: a container; a conveying mechanism configured to convey a recording medium contained in the container; a recording head configured to record an image on the recording medium that has been conveyed through a conveying path by the conveying mechanism; a moving mechanism including a carriage and configured to move the carriage reciprocatingly together with the recording head; a first sensor installed in the carriage and configured to detect the recording medium; a second sensor configured to detect a change of a state of the container; a storage unit configured to store width information of the recording medium that is conveyed by the conveying mechanism; and a controller configured to control the conveying mechanism, the moving mechanism, and the recording head.

9 Claims, 11 Drawing Sheets

Related U.S. Application Data continuation of application No. 14/672,853, filed on Mar. 30, 2015, now Pat. No. 9,254,696.

(56) References Cited

U.S. PATENT DOCUMENTS

| | | | | |
|---|---|---|---|---|
| 8,926,054 | B2 | 1/2015 | Emoto et al. | |
| 9,254,696 | B2 * | 2/2016 | Samoto | B41J 13/0009 |
| 2008/0240832 | A1 | 10/2008 | Kugimachi | |

FOREIGN PATENT DOCUMENTS

| | | | |
|---|---|---|---|
| JP | 2006-36429 | A | 2/2006 |
| JP | 2006-224391 | A | 8/2006 |
| JP | 4062428 | B2 | 3/2008 |
| JP | 2008-247570 | A | 10/2008 |
| JP | 4733575 | B2 | 7/2011 |
| JP | 2013-063553 | A | 4/2013 |

* cited by examiner

RECORDING APPARATUS

CROSS REFERENCE TO RELATED APPLICATION

The present application is continuation of U.S. patent application Ser. No. 15/016,687, filed Feb. 5, 2016, which is a continuation of U.S. patent application Ser. No. 14/672,853, filed Mar. 30, 2015, and further claims priority from Japanese Patent Application No. 2014-072720, filed on Mar. 31, 2014, the disclosures of which are incorporated herein by reference in their entirety.

BACKGROUND

Field of the Invention

The present invention relates to a recording apparatus which records an image on a recording medium.

Description of the Related Art

In Japanese Patent No. 4062428, an ink-jet recording apparatus, which detects a width of a recording paper for each recording paper at the time of recording an image on the recording paper, has been described. In the ink-jet recording apparatus described, at the time of carrying out a first main scanning operation of a recording head, two end portions of the recording paper are detected by a sensor, and the width of the recording paper is acquired. Since the width of the recording paper is acquired for each recording paper, it is possible to maintain an image quality.

SUMMARY

However, in the ink-jet recording apparatus described in Japanese Patent No. 4062428, for acquiring the width of the recording paper for each recording paper, it is necessary to move the sensor to positions at which the sensor can detect both ends of the recording paper respectively, for each recording paper. For instance, when recording jobs for recording images on one or more than one recording papers are received one by one and when an image according to each recording job is recorded on one of the recording papers, the width of each recording paper is acquired for each recording paper. This leads to a problem that a time from receipt of the recording job to discharge of the recording paper having an image recorded thereon becomes long, for each recording job.

Therefore, an object of the present teaching is to provide a recording apparatus which is capable of shortening the time from receipt of a recording job to discharge of a recording medium having an image according to the recording job recorded thereon.

According to a first aspect of the present teaching, there is provided a recording apparatus including: a container configured to contain a recording medium; a conveying mechanism configured to convey the recording medium contained in the container along a conveying path; a recording head configured to record an image on the recording medium that has been conveyed in a first direction through the conveying path by the conveying mechanism; a moving mechanism including a carriage that supports the recording head and configured to move the carriage reciprocatingly together with the recording head in a second direction which intersects the first direction; a first sensor installed in the carriage on an upstream side of the recording head in the first direction and configured to detect the recording medium; a second sensor configured to detect a change of a state of the container; a storage unit configured to store width information relating to the second direction of the recording medium that is conveyed by the conveying mechanism; and a controller configured to control the conveying mechanism, the moving mechanism, and the recording head to record an image on at least one recording medium based on width information and a recording job which is a series of processing corresponding to a recording command, and configured to judge whether a predetermined condition for updating the width information is satisfied, the predetermined condition being detection of the change in the state of the container by the second sensor; wherein after the controller judged that the predetermined condition has been satisfied, and before an image is recorded on a first recording medium based on the recording job, the controller is configured to: acquire width information of the first recording medium by detecting two ends in the second direction of the first recording medium by the first sensor; and store the width information of the first recording medium, which has been acquired, in the storage unit until the controller judges next time that the predetermined condition has been satisfied.

According to a second aspect of the present teaching, there is provided a recording apparatus including: a container configured to contain a recording medium; a conveying mechanism configured to convey the recording medium contained in the container along a conveying path; a recording head configured to record an image on the recording medium that has been conveyed in a first direction through the conveying path by the conveying mechanism; a moving mechanism including a carriage that supports the recording head and configured to move the carriage reciprocatingly together with the recording head in a second direction which intersects the first direction; a first sensor installed in the carriage on an upstream side of the recording head in the first direction and configured to detect the recording medium; a jam sensor provided for the conveying path and configured to detect jamming of the recording medium in the conveying path; a storage unit configured to store width information relating to the second direction of the recording medium that is conveyed by the conveying mechanism; and a controller configured to control the conveying mechanism, the moving mechanism, and the recording head to record an image on at least one recording medium based on width information and a recording job which is a series of processing corresponding to a recording command, and configured to judge whether a predetermined condition for updating the width information is satisfied, the predetermined condition being detection of the jamming of the recording medium in the conveying path by the jam sensor; wherein after the controller judged that the predetermined condition has been satisfied, and before an image is recorded on a first recording medium based on the recording job, the controller is configured to: acquire width information of the first recording medium by detecting two ends in the second direction of the first recording medium by the first sensor; and store the width information of the first recording medium, which has been acquired, in the storage unit until the controller judges next time that the predetermined condition has been satisfied.

Accordingly, even at the time of recording images on the plurality of recording media based on the plurality of recording jobs, the width information of the first recording medium is maintained in the storage unit and not updated until the second sensor detects a change in the state of the container next time or until the jam sensor detects the jamming of the recording medium in the conveying path next time. Therefore, an image is recorded on the recording medium based on the width information maintained in the storage unit until the second sensor detects the change in the state of the container or until the jam sensor detects the jamming of the recording medium in the conveying path next time. Accordingly, it is not necessary to update the width information for each recording job, and with respect to a recording job for which updating of the width information is not required, it is possible to shorten the time period from receiving the recording job to discharging the recording medium on which the image has been recorded.

DETAILED DESCRIPTION OF THE EMBODIMENTS

Figure 1:
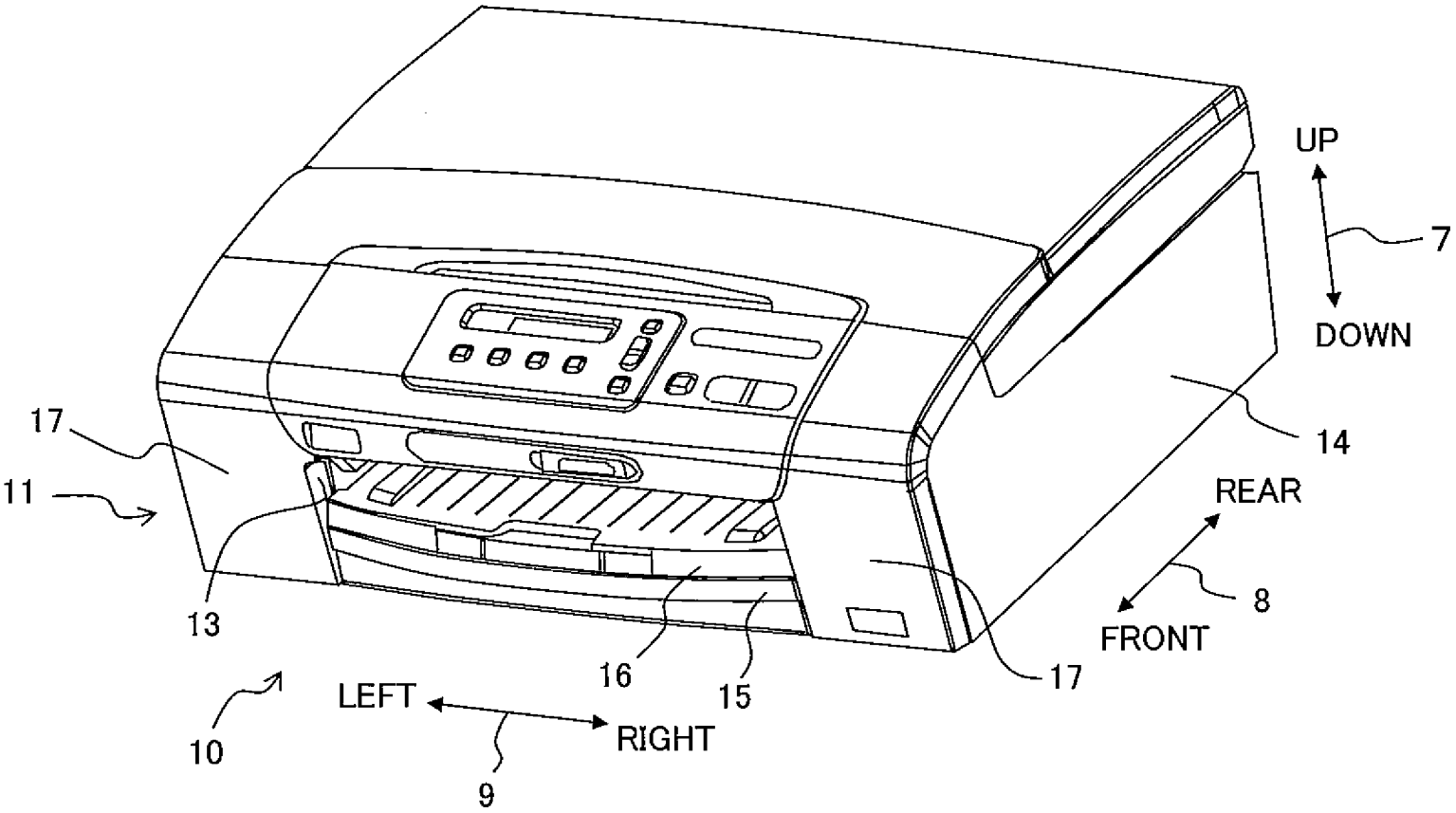
FIG. 1 is a perspective view of a multi-function peripheral.

A multi-function peripheral 10 in which a printer unit according an embodiment of the present teaching is adopted will be described below. The multi-function peripheral 10 is used while being placed in a state shown in FIG. 1. In the present embodiment, three directions indicated by arrow marks in FIG. 1 are an up-down direction 7, a front-rear direction 8, and a left-right direction 9. The three directions indicated in FIG. 1 are similar in the other diagrams as well.

<Outline of Multi-Function Peripheral>

As shown in FIG. 1, the multi-function peripheral 10 is formed to be substantially thin rectangular parallelepiped. A printer unit 11 which is an example of a recording apparatus of the present teaching is provided at a lower portion of the multi-function peripheral 10. The multi-function peripheral 10 has various functions such as a facsimile function and a print function.

The printer unit 11 includes a casing 14 which covers the periphery. A front wall 17 is arranged on a front side of the casing 14, and is spread in the up-down direction 7 and the left-right direction 9 respectively. An opening 13 is formed at a substantially central portion of the front wall 17. The printer unit 11 is provided with a paper feeding tray 15 and a paper discharge tray 16 at a lower stage and an upper stage respectively, to be exposed partially from the opening 13. The paper feeding tray 15 can be inserted into and drawn out through the opening 13 in the front-rear direction 8, or is arranged to be detachable from the casing 14. The paper feeding tray 15 in the present embodiment is capable of containing papers P of various sizes from A4 and smaller than A4. A paper P contained in the paper feeding tray 15 is conveyed to an interior of the printer unit 11, and a desired image is printed thereon, and the paper P is discharged to the paper discharge tray 16.

The multi-function peripheral 10 is connected to an external equipment such as a personal computer (hereinafter referred to as a PC) mainly. The multi-function peripheral 10 records an image (including a text) on the paper P based on a recording job (data which indicates a series of processing corresponding to a recording command for recording an image on one or more than one paper P) transferred from the PC and including image data.

<Internal Structure of Printer Unit>

Figure 2:
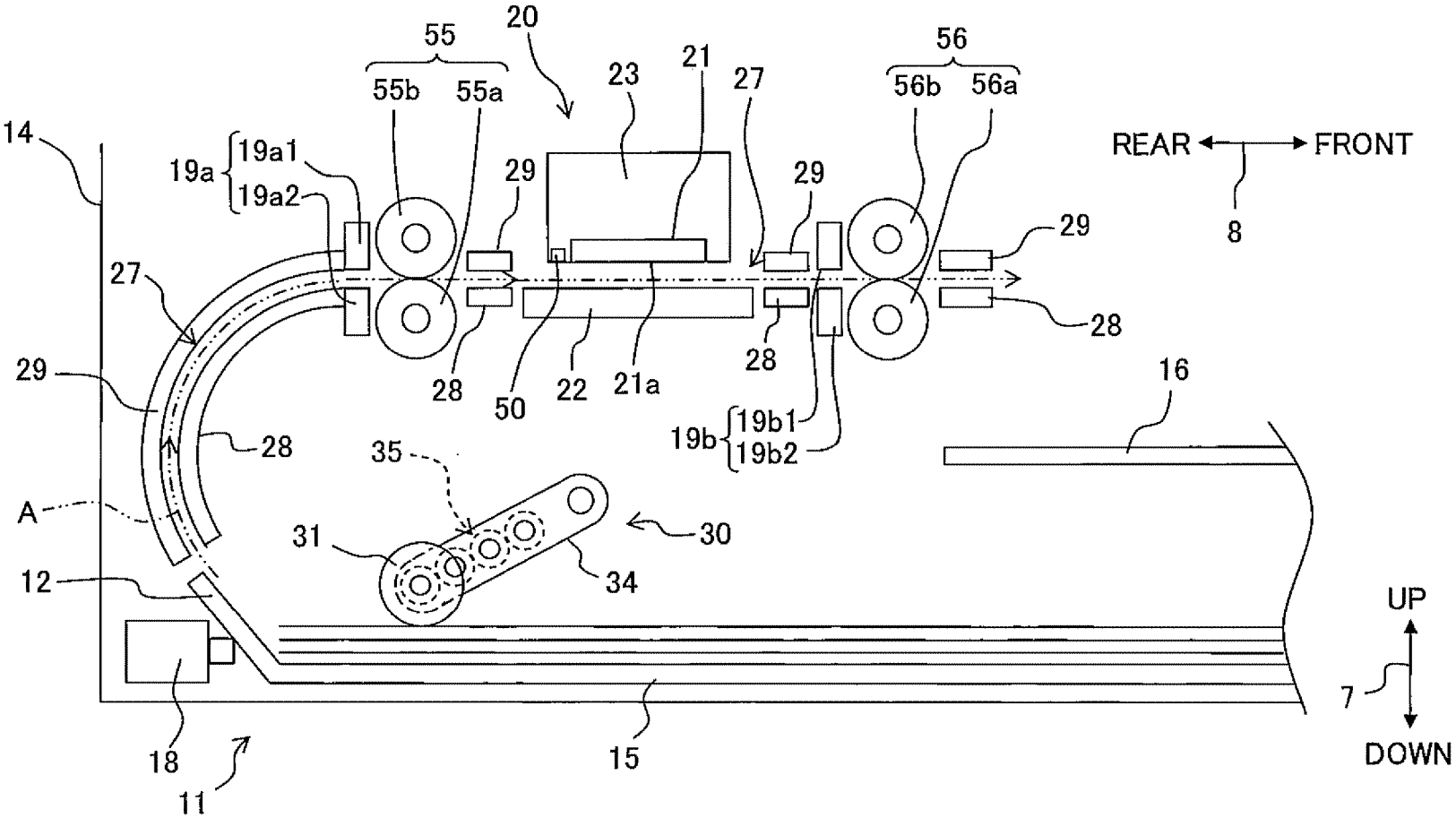
FIG. 2 is a schematic side view showing an internal structure of a printer unit shown in FIG. 1.

Next, an internal structure of the printer unit 11 will be described below. As shown in FIG. 2, the printer unit 11 includes a feeding unit 30, a pair of conveying rollers 55, a recording unit 20, a pair of discharge rollers 56, an attachment/detachment sensor 18 (an example of the second sensor), a first paper sensor 19*a*, a second paper sensor 19*b*, a width detection sensor 50 (an example of the first sensor, refer to FIG. 4), and a control unit 5 (an example of the controller, refer to FIG. 6), and the casing 14 contains these components. The first paper sensor 19*a* and the second paper sensor 19*b* are examples of the jam sensor. The feeding unit 30 feeds paper P contained in the paper feeding tray 15 to a conveying path 27. The pair of conveying rollers 55 conveys the paper P fed by the feeding unit 30, to the recording unit 20. The recording unit 20 has an arrangement of, for example, an ink-jet recording type, and records an image on the paper P conveyed by the pair of conveying rollers 55. The pair of discharge rollers 56 discharges the paper P having the image recorded thereon by the recording unit 20, to the paper discharge tray 16.

<Feeding Unit>

As shown in FIG. 2, the feeding unit 30 is provided at an upper side of the paper feeding tray 15. The feeding unit 30 includes a paper feeding roller 31, a paper feeding arm 34, and a gear train 35. The paper feeding roller 31 is rotatably supported by an end portion of the paper feeding arm 34. The paper feeding arm 34 is pivotally attached to a frame (not shown in the diagram) of the printer unit 11. Accordingly, the paper feeding roller 31 is arranged to be movable upward and downward with respect to the paper feeding tray 15. The gear train 35 includes a plurality of gears arranged in a row inside the paper feeding arm 34. In this arrangement, as a drive motor 30M (refer to FIG. 6) is driven, the driving force is transmitted to the gear train 35, and the paper feeding roller 31 is rotated in a clockwise direction in FIG. 2. The paper feeding roller 31 rotates in a state of being in a pressed contact with the paper P on the paper feeding tray 15. Due to the rotation of the paper feeding roller 31, the stacked papers P are conveyed to the conveying path 27.

<Paper Feeding Tray>

As shown in FIG. 2, the paper feeding tray 15 includes an inclined wall portion 12. The inclined wall portion 12 guides a paper P to the conveying path 27 when the paper P placed in the paper feeding tray 15 is fed by the paper feeding roller 31. Moreover, the paper feeding tray 15 is provided with a guiding mechanism (not shown in the diagram) which aligns a center of the contained paper P with a center of the conveying path 27 in the left-right direction 9 by an operation of a user. Accordingly, it is possible to feed the paper P to the conveying path 27 in a state that the center of the paper P is aligned as far as possible with the center of the conveying path 27 in the left-right direction 9. The guiding mechanism may align the paper P such that one end of the paper P is along one end of the conveying path 27, in the left-right direction 9.

<Attachment/Detachment Sensor>

The attachment/detachment sensor 18 is arranged at a position which is at a lower portion on a rear side of the casing 14, and facing the inclined wall portion 12 of the paper feeding tray 15, in the front-rear direction 8. The attachment/detachment sensor 18 is a so-called push-button switch, and has a protrusion 18*a* which is movable in the front-rear direction and which is biased frontward. When the paper feeding tray 15 is attached to the casing 14, the protrusion 18*a* is pressed by the paper feeding tray 15 as shown in FIG. 2. At this time, the attachment/detachment sensor 18 outputs a detection signal, to the control unit 5, indicating that the paper feeding tray 15 has been attached to the casing 14. Whereas, when the paper feeding tray 15 is detached from the casing 14, the protrusion 18*a* is not pressed by the paper feeding tray 15, and the protrusion 18*a* has a state of protruding further frontward as compared with the state shown in FIG. 2. At this time, the attachment/detachment sensor 18 outputs a detection signal, to the control unit 5, indicating that the paper feeding tray 15 has not been attached to the casing 14. Accordingly, the control unit 5 is capable of detecting attachment and detachment of the paper feeding tray 15. The attachment/detachment sensor 18 may be a sensor of a type other than the push-button switch type, and may be any sensor such as an optical sensor, provided that it is capable of outputting a signal indicating a change of an attachment state of the paper feeding tray 15.

<Conveying Path>

As shown in FIG. 2, the conveying path 27 is bent upward and frontward of the printer unit 11 from an end portion on a rear side of the paper feeding tray 15, and is extended toward a front-surface side from a rear-surface side (rear side) of the printer unit 11. Furthermore, the conveying path 27 is lead to the paper discharge tray 16 passing through a pinching position of the pair of conveying rollers 55, a lower side of the recording unit 20, and a pinching position of the pair of discharge rollers 56. The paper P fed from the paper feeding tray 15 is guided to make a U-turn from a lower portion to an upper portion of the casing 14, and reaches the recording unit 20. After an image recording is carried out on the recording paper P by the recording unit 20, the paper P having an image recorded thereon is discharged to the paper discharge tray 16. The conveying path 27 is defined between an outer-side guide member 29 and an inner-side guide member 28 mutually facing with a predetermined spacing distance intervening therebetween, except for locations where components such as the recording unit 20 are arranged. Moreover, a location of the conveying path 27 where the recording unit 20 is installed is arranged between a recording head 21 which will be described later and a platen 22 (mainly an area on the platen 22), and an image is recorded on the paper P when the paper P passes over this portion of the conveying path 27.

<Pair of Conveying Rollers and Pair of Discharge Rollers>

The description will be made below letting a direction in which the paper P is conveyed along the conveying path 27 (a direction indicated by an alternate long and two short dashes line in FIG. 2) to be a conveying direction A. As shown in FIG. 2, the pair of conveying roller 55 is provided at an upstream side of the recording unit 20 in the conveying direction A. The pair of conveying rollers 55 includes a conveying roller 55*a* which is arranged at a lower side of the conveying path 27 and a pinch roller 55*b* which is arranged at an upper side of the conveying path 27. The pinch roller 55*b* rotates along with the conveying roller 55*a*. The conveying roller 55*a* and the pinch roller 55*b* together pinch the paper P in the up-down direction 7, and convey the paper P in the conveying direction A. The conveying roller 55*a* may be provided at an upper side of the pinch roller 55*b*.

The pair of discharge rollers 56 is provided at a downstream side of the recording unit 20 in the conveying direction A. The pair of discharge rollers 56 includes a discharge roller 56*a* which is arranged at a lower side of the conveying path 27, and a spur roller 56*b* which is arranged at an upper side of the conveying path 27. The spur roller 56*b* rotates along with the paper discharge roller 56*a*. The discharge roller 56*a* and the spur roller 56*b* together pinch the paper P in the up-down direction 7, and convey the paper P in the conveying direction A. The paper discharge tray 16 is arranged at a downstream side of the pair of discharge rollers 56 in the conveying direction A. The paper discharge tray 16 is provided at a downstream side of the recording unit 20 in the conveying direction A.

As the drive motor 30M is driven, the driving force of the drive motor 30M is transmitted by a transmission mechanism which is not shown in the diagram to the conveying roller 55*a* and the discharge roller 56*a* in the pair of conveying rollers 55 and the pair of discharge rollers 56 respectively, and the conveying roller 55*a* and the paper discharge roller 56*a* rotate in a clockwise direction in FIG. 2. At this time, the conveying roller 55*a* and the discharge roller 56*a* are driven intermittently with a predetermined linefeed width. The rotation of the conveying roller 55*a* and the rotation of the discharge roller 56*a* are synchronized, and the rotation of the conveying roller 55*a* and the rotation of the discharge roller 56*a* are controlled by being detected by a rotary encoder 57 (refer to FIG. 6) provided for the conveying roller 55*a*. Thus, the paper P pinched between the pair of conveying rollers 55 is conveyed intermittently on the platen 22 at a predetermined linefeed width. The recording head 21 is scanned for each line feeding, and image recording is carried out from a front-end side of the paper P. The front-end side of the paper P subjected to image recording is, thereafter, pinched between the pair of discharge rollers 56. Consequently, the paper P is conveyed intermittently at the predetermined line feed width in a state that the front-end side of the paper P is pinched between the pair of discharge rollers 56 and a rear-end side thereof is pinched between the pair of conveying rollers 55, and image recording is carried out on the paper P by the recording head 21 in a similar manner. As the paper P is conveyed further, the rear end of the paper P passes through the pair of conveying rollers 55, and is released from the state of being pinched between the pair of conveying rollers 55. Consequently, the paper P is conveyed intermittently with the predetermined linefeed width upon being pinched between the pair of discharge rollers 56, and the image recording is carried out on the paper P by the recording head 21 in a similar manner. After the image recording has been carried out on a predetermined area of the paper P, the discharge roller 56*a* is driven to be rotated continuously. Accordingly, the paper P pinched between the pair of discharge rollers 56 is discharged to the paper discharge tray 16. In such manner, the conveying mechanism of the present teaching, which conveys the paper P, is formed by the feeding unit 30, the pair of conveying rollers 55, and the pair of discharge rollers 56.

<First Paper Sensor>

The first paper sensor 19*a* is arranged near and upstream side of the pair of conveying rollers 55 in the conveying direction A. The first paper sensor 19*a* includes a light emitting portion 19*a*1 which is arranged at an upper side of the conveying path 27, and a light receiving portion 19*a*2 which is arranged at a lower side of the conveying path 27. The light emitting portion 19*a*1 includes a light emitting diode. The light receiving portion 19*a*2 includes an optical sensor. The light emitting portion 19*a*1 and the light receiving portion 19*a*2 are arranged at a center of the conveying path 27 in a direction (the left-right direction 9) orthogonal to the conveying direction A. Moreover, the light emitting portion 19*a*1 and the light receiving portion 19*a*2 are arranged to face mutually, and the light receiving portion 19*a*2 is arranged to receive light from the light emitting portion 19*a*1. The first paper sensor 19*a* detects a front end of the paper P when the light from the light emitting portion 19*a*1 to the light receiving portion 19*a*2 is blocked by the paper P during the conveyance of the paper P, and outputs a detection signal of the paper P to the control unit 5. Accordingly, the control unit 5 is capable of detecting a position of the front end of the paper P.

<Second Paper Sensor>

The second paper sensor 19*b* is arranged near the pair of discharge rollers 56 and between the recording unit 20 and the pair of discharge rollers 56. The second paper sensor 19*b* includes a light emitting portion 19*b*1 which is arranged at an upper side of the conveying path 27, and a light receiving portion 19*b*2 which is arranged at a lower side of the conveying path 27. The light emitting portion 19*b*1 includes a light emitting diode. The light receiving portion 19*b*2 includes an optical sensor. The light emitting portion 19*b*1 and the light receiving portion 19*b*2 are arranged at the center of the conveying path 27 with respect to the direction (the left-right direction 9) orthogonal to the conveying direction A. Moreover, the light emitting portion 19*b*1 and the light receiving portion 19*b*2 are arranged to face mutually, and the light receiving portion 19*b*2 is arranged to receive light from the light emitting portion 19*b*1. The second paper sensor 19*b* detects the front end of the paper P when the light from the light emitting portion 19*b*1 to the light receiving portion 19*b*2 is blocked by the paper P during the conveyance of the paper P, and outputs a detection signal of the paper P to the control unit 5. Accordingly, the control unit 5 is capable of detecting the paper P, and is capable of making a judgment of whether or not a jamming of the paper P has occurred in a portion of the conveying path 27 between the first paper sensor 19*a* and the second paper sensor 19*b*.

<Recording Unit>

Figure 3:
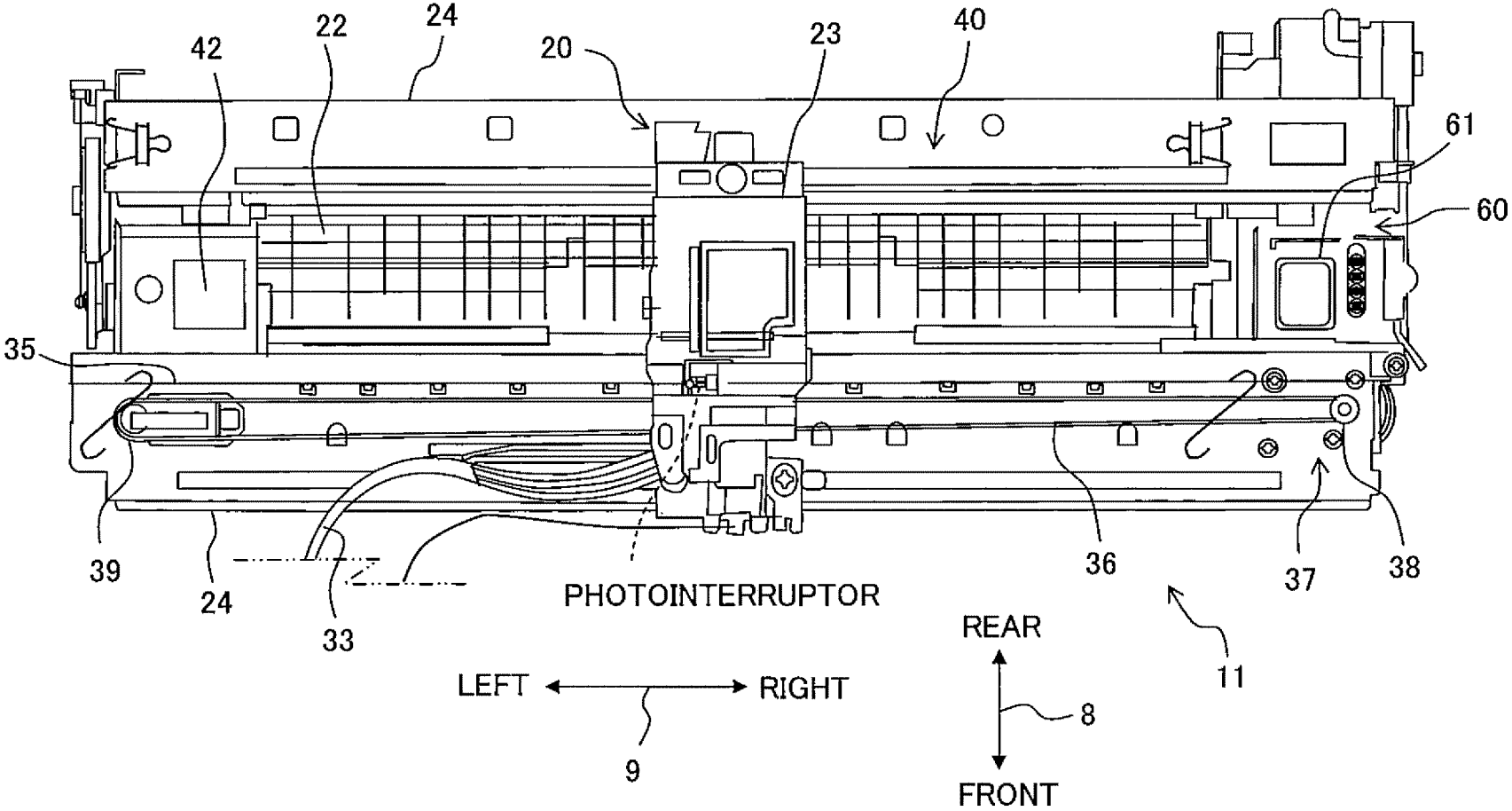
FIG. 3 is a plan view of main components of the printer unit shown in FIG. 1.

As shown in FIG. 2 and FIG. 3, the recording unit 20 includes the recording head 21, a moving mechanism 40, and the platen 22. The moving mechanism 40 includes a carriage 23. The carriage 23 reciprocates in a scanning direction (which is the left-right direction 9, and is orthogonal to the conveying direction A). The carriage 23, as shown in FIG. 2, supports the recording head 21 at a lower side of the carriage 23. A bottom surface of the recording head 21 is a jetting surface 21*a* in which a plurality of nozzles 21*b* (refer to FIG. 4) is formed. Each of the plurality of nozzles 21*b* jets an ink onto the recording paper P conveyed beneath the recording head 21. The platen 22 is arranged below the jetting surface 21*a*, and supports the paper P which is conveyed by the pair of conveying rollers 55.

As shown in FIG. 3, inks of magenta (M), cyan (C), yellow (Y), and black (Bk) colors are supplied from ink tanks which are not shown in the diagram to the recording head 21 through ink tubes 33. The recording head 21 jets the inks of various colors as fine ink droplets through the nozzles 21*b* by a control of the control unit 5 based on a recording job. In other words, an image is recorded on the paper P that is conveyed on the platen 22, when the recording head 21 is scanned with respect to the paper P due to the reciprocation of the carriage 23 in the left-right direction 9 and the ink droplets of various colors are jetted through the nozzles 21*b*.

As shown in FIG. 3, the moving mechanism 40 includes a pair of guide rails 24 and a belt transmission mechanism 37. Guide rails in the pair of guide rails 24 are arranged to be isolated in the front-rear direction 8. The pair of guide rails 24 extends in the left-right direction 9 to be parallel. The carriage 23 is arranged to span the pair of guide rails 24, and reciprocates along the left-right direction on the pair of guide rails 24.

The belt transmission mechanism 37 is arranged on an upper surface of the guide rail 24 on a front side. The belt transmission mechanism 37 includes two pulleys 38 and 39, and a timing belt 36. The pulley 38 is provided for a right-end portion of the guide rail 24 on the front side, and the pulley 39 is provided for a left-end portion of the guide rail 24 on the front side. The timing belt 36 is an endless belt put around the pulleys 38 and 39. A driving force from the carriage drive motor 40M (refer to FIG. 6) is inputted to the pulley 38. In this mechanism, as the carriage drive motor 40M is driven, the pulley 38 rotates, and the timing belt 36 is turned around. The timing belt 36 is fastened to the carriage 23. Consequently, the reciprocating of the carriage 23 is realized by turning around of the timing belt 36.

A linear encoder 35 in the form of a strip is installed along the left-right direction 9 on the guide rail 24 on the front side. In the linear encoder 35, detection is made by a photo interrupter (a component of the linear encoder 35), and the reciprocating of the carriage 23 is controlled according to an encoder amount.

The platen 22 is arranged to spread over a central portion, within a reciprocation area of the carriage 23, on which the paper P passes. A width of the platen 22 in the left-right direction 9 is sufficiently larger than the maximum width of the paper P that can be conveyed (width of A4 size in the present embodiment), and the two ends of the paper P in the left-right direction 9 surely pass over the platen 22. Moreover, for a color of an upper surface of the platen 22 which carries the paper P, a color having a reflectivity different from a reflectivity of white color (which is the color of the paper P in general) is suitable, and a color which is particularly preferable is black color.

Moreover, as shown in FIG. 3, a maintenance mechanism 60 is arranged on a right side of the platen 22 in the left-right direction 9, and a waste-ink tray 42 is arranged on a left side of the platen 22. In other words, the maintenance mechanism 60 and the waste-ink tray 42 are arranged outside of the conveying path 27 through which the paper P is conveyed. The maintenance mechanism 60 is a mechanism for preventing drying of the jetting surface 21*a* and for eliminating air bubbles and foreign particles together with the ink from the nozzles 21*b* by suction. The maintenance mechanism 60 includes a cap which covers the jetting surface 21*a* of the recording head 21, a pump mechanism (not shown in the diagram) which is to be connected to the recording head 21 via the cap 61, and a moving mechanism (not shown in the diagram) for bringing the cap in contact with or separating the cap from the jetting surface 21*a* of the recording head 21. At the time of eliminating air bubbles etc. in the recording head 21, the carriage 23 is moved such that the recording head 21 is positioned above the cap 61. In this state, the cap 61 is moved upward and is brought in a close contact such that the cap 61 seals the nozzles 21*b* of the jetting surface 21*a* of the recording head 21, and the ink is sucked from the nozzles 21*b* of the recording head 21 by the pump mechanism which is connected to the cap 61.

The waste-ink tray 42 is a tray for receiving the ink that is jetted preliminarily from the recording head 21. Moreover, the preliminary jetting is called as flushing. By carrying out flushing of the recording head 21, the drying of the ink inside the nozzles 21*b* is suppressed. Moreover, a felt is laid in the waste-ink tray 42. When the recording head 21 carries out flushing, the ink that has been jetted preliminarily is absorbed by the felt.

<Width Detection Sensor>

Figure 4:
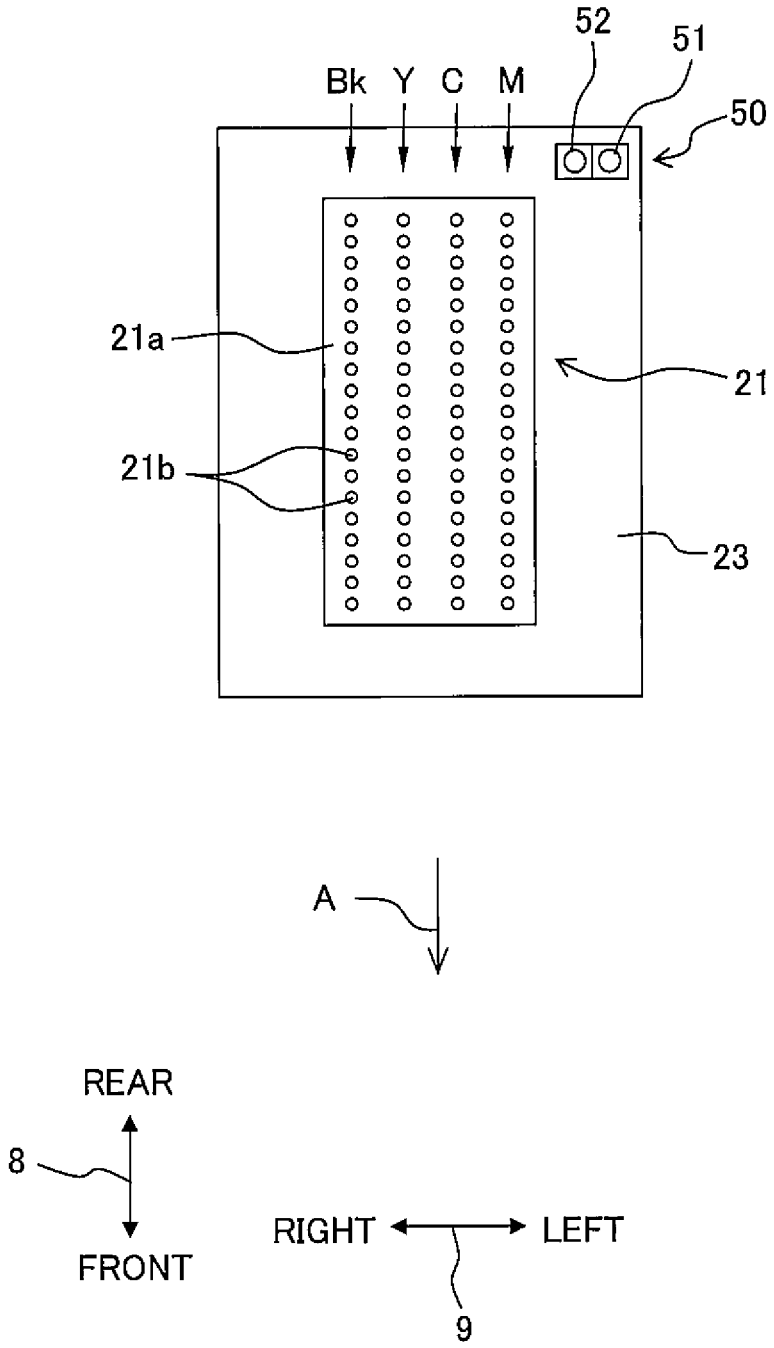
FIG. 4 is a bottom view of a carriage and a recording head shown in FIG. 2.
Figure 5:
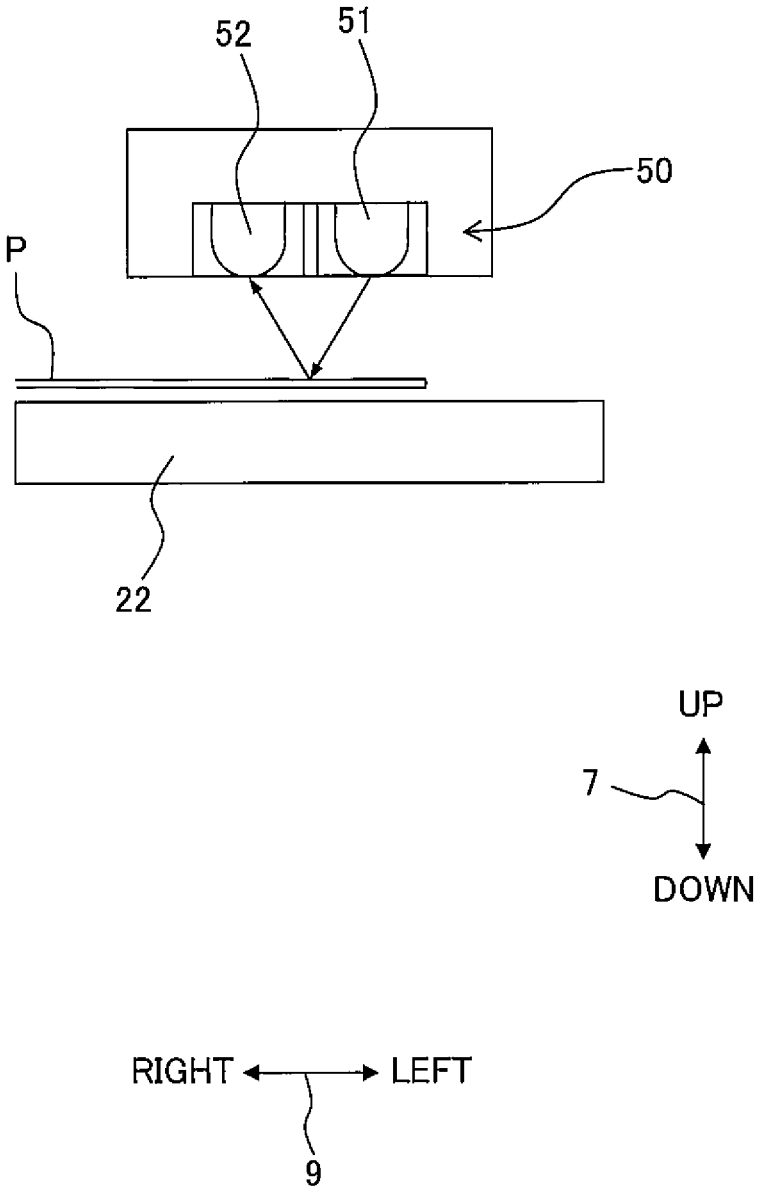
FIG. 5 is a partial cross-sectional view of a width detection sensor shown in FIG. 4.

As shown in FIG. 4, the width detection sensor 50 is mounted on the carriage 23 along with the recording head 21. As shown in FIG. 4 and FIG. 5, the width detection sensor 50 includes a light emitting portion 51 which includes a light emitting diode, and a light receiving portion 52 which includes an optical sensor. As shown in FIG. 5, the width detection sensor 50 is configured such that the light emitting portion 51 irradiates light toward the platen 22, and the light receiving portion 52 receives the light reflected.

The color of the upper surface of the platen 22 is a color having the reflectivity different from the reflectivity of paper P, such as black color. In a case that there is no recording paper P on the platen 22, since the light receiving portion 52 receives light reflected from the platen 22 having a low reflectivity, detected value (AD value) by the width detection sensor 50 becomes low. Whereas, in a case that there is a paper P on the platen 22, since the light receiving portion 52 receives light reflected from the paper P having a high reflectivity, the detected value (AD value) by the width detection sensor 50 becomes high. Consequently, it is possible to detect the presence or absence of the paper P by a difference in an amount of reflected light which is received by the width detection sensor 50.

As shown in FIG. 4, the width detection sensor 50 is mounted on the carriage 23 at an upstream side of the recording head 21 in the conveying direction A (in other words, between the recording head 21 and the pair of conveying rollers 55), and is configured to reciprocate in the scanning direction by the carriage 23. Accordingly, it is possible to detect position information of the left-end portion and the right-end portion of the paper P, and it is possible to acquire width information of the paper P that is conveyed. As shown in FIG. 4, in the ink jetting surface 21*a* of the recording head 21, the plurality of nozzles 21*b* are aligned in the conveying direction A of the paper P for each color ink of magenta, cyan, yellow, and black. The number of nozzles 21*b* and a pitch of adjacent nozzles 21*b* in the conveying direction A may be set appropriately upon taking into consideration factors such as resolution. Moreover, the number of rows of the nozzles 21*b* may be increased or decreased according to the number of colors of ink.

<Control Unit>

Figure 6:
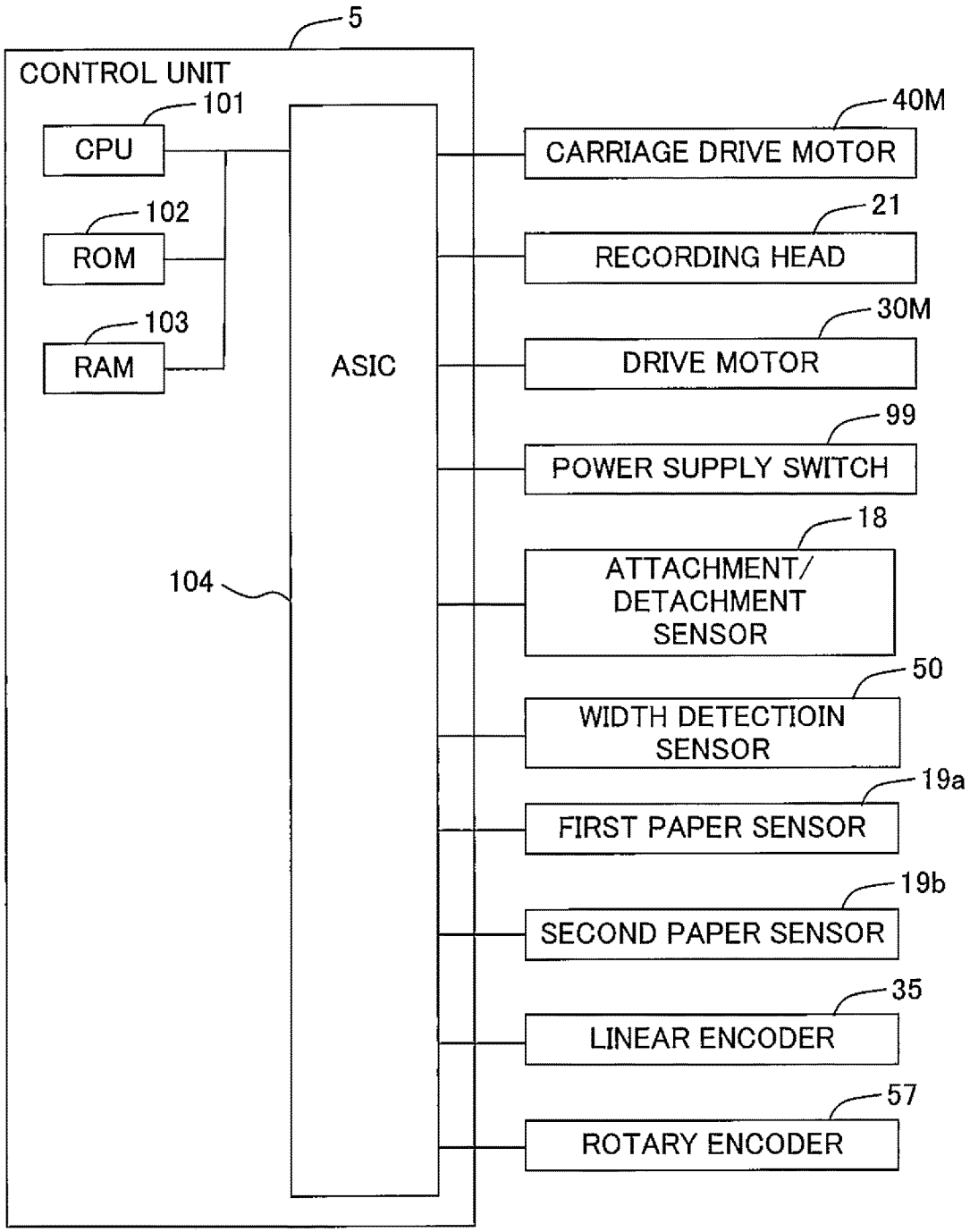
FIG. 6 is a block diagram showing an electrical configuration of the printer unit.

As shown in FIG. 6, the control unit 5 includes a CPU (central processing unit) 101, a ROM (read only memory) 102, a RAM (random access memory) 103, and an ASIC (application specific integrated circuit) 104, and these components cooperate to control operation of the carriage drive motor 40, the recording head 21, the drive motor 30M, and the like. For example, the control unit 5 controls the drive motor 30M, the carriage drive motor 40M, the recording head 21, and the like, based on a recording job that has been transmitted from an external apparatus such as a PC, to record an image etc. on the paper P. Data (such as image data, and information of paper P on which the image is to be recorded), which is necessary at the time of executing a computer program, is stored temporarily in the RAM 103. In other words, the RAM 103 corresponds to a storage unit of the present teaching. Moreover, as shown in FIG. 6, the attachment/detachment sensor 18, the width detection sensor 50, the first paper sensor 19*a*, the second paper sensor 19*b*, the linear encoder 35, the rotary encoder 57, and a power supply switch 99 are connected to the control unit 5.

Moreover, in FIG. 6, one CPU 101 and one ASIC 104 are shown. However, the control unit 5 may include only one CPU 101, and this only one CPU 101 may carry out the necessary processing collectively, or the control unit 5 may include a plurality of CPUs 101, and the plurality of CPUs 101 may carry out the necessary processing by sharing. Moreover, the control unit 5 may include only one ASIC 104, and this only one ASIC 104 may carry out the necessary processing collectively, or the control unit 5 may include a plurality of ASICs 104, and the plurality of ASICs may carry out the necessary processing by sharing.

Figure 7A:
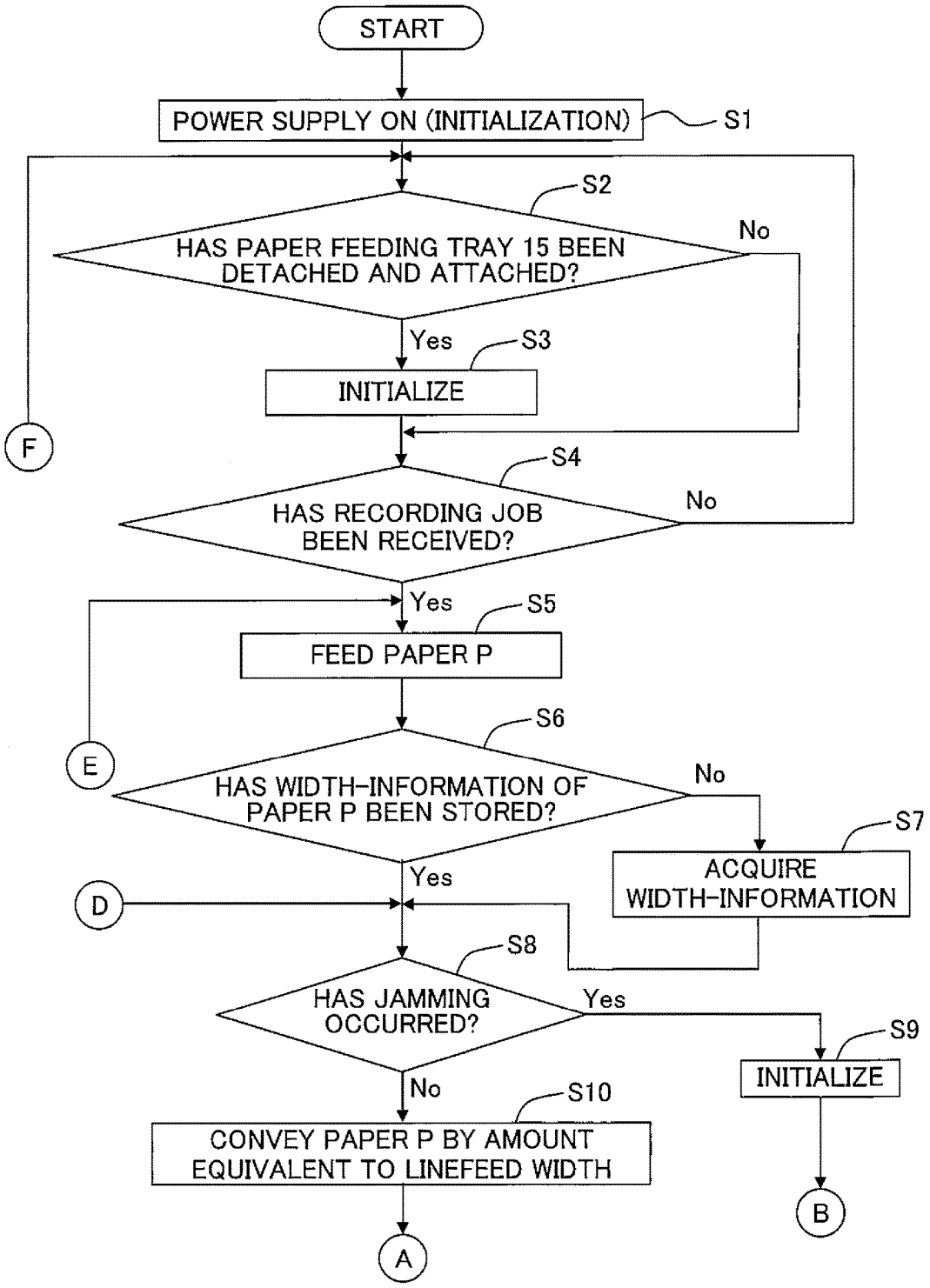
FIGS. 7A to 7C show a flowchart showing a procedure of an image recording operation of the printer unit.
Figure 7B:
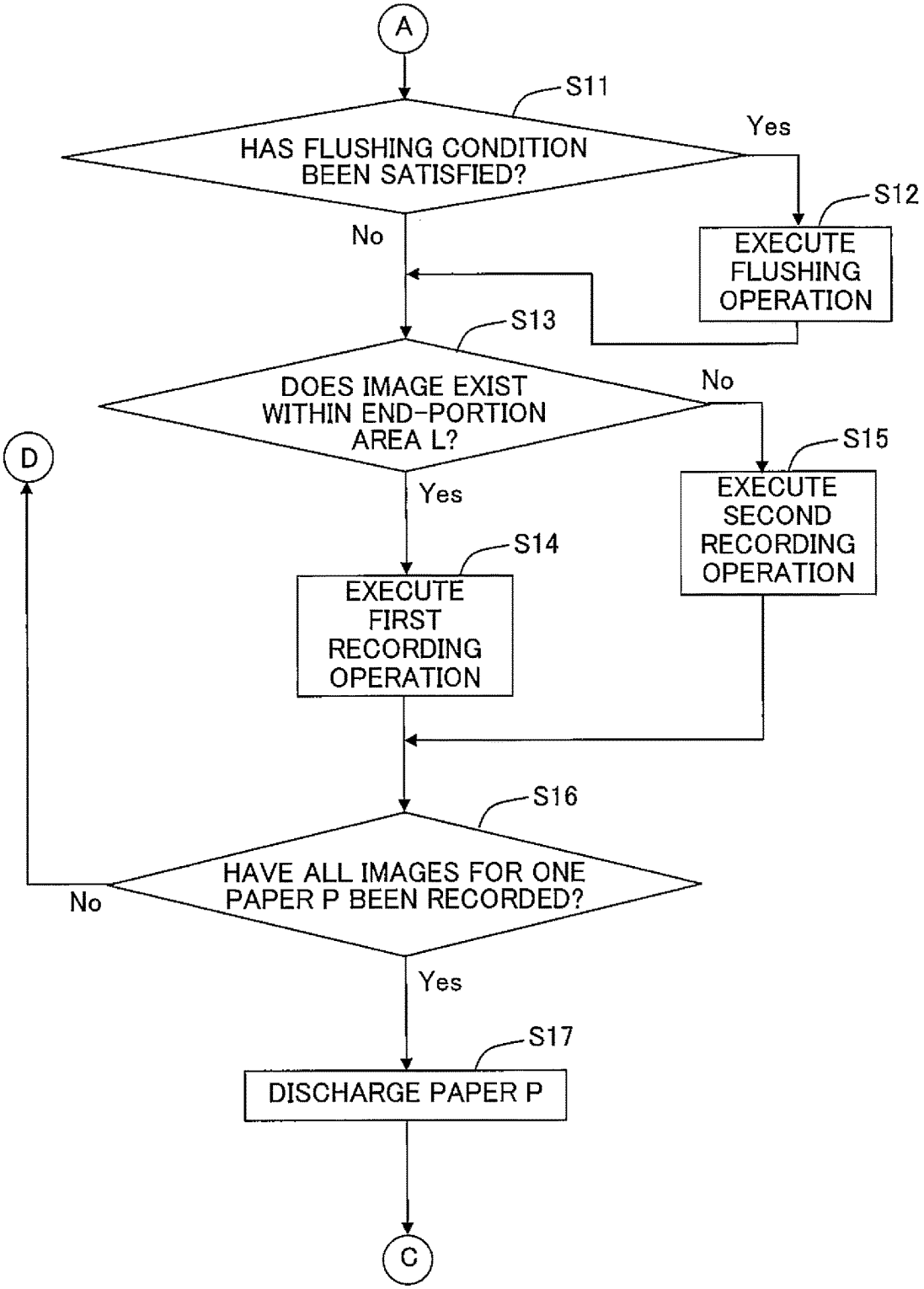
Figure 7C:
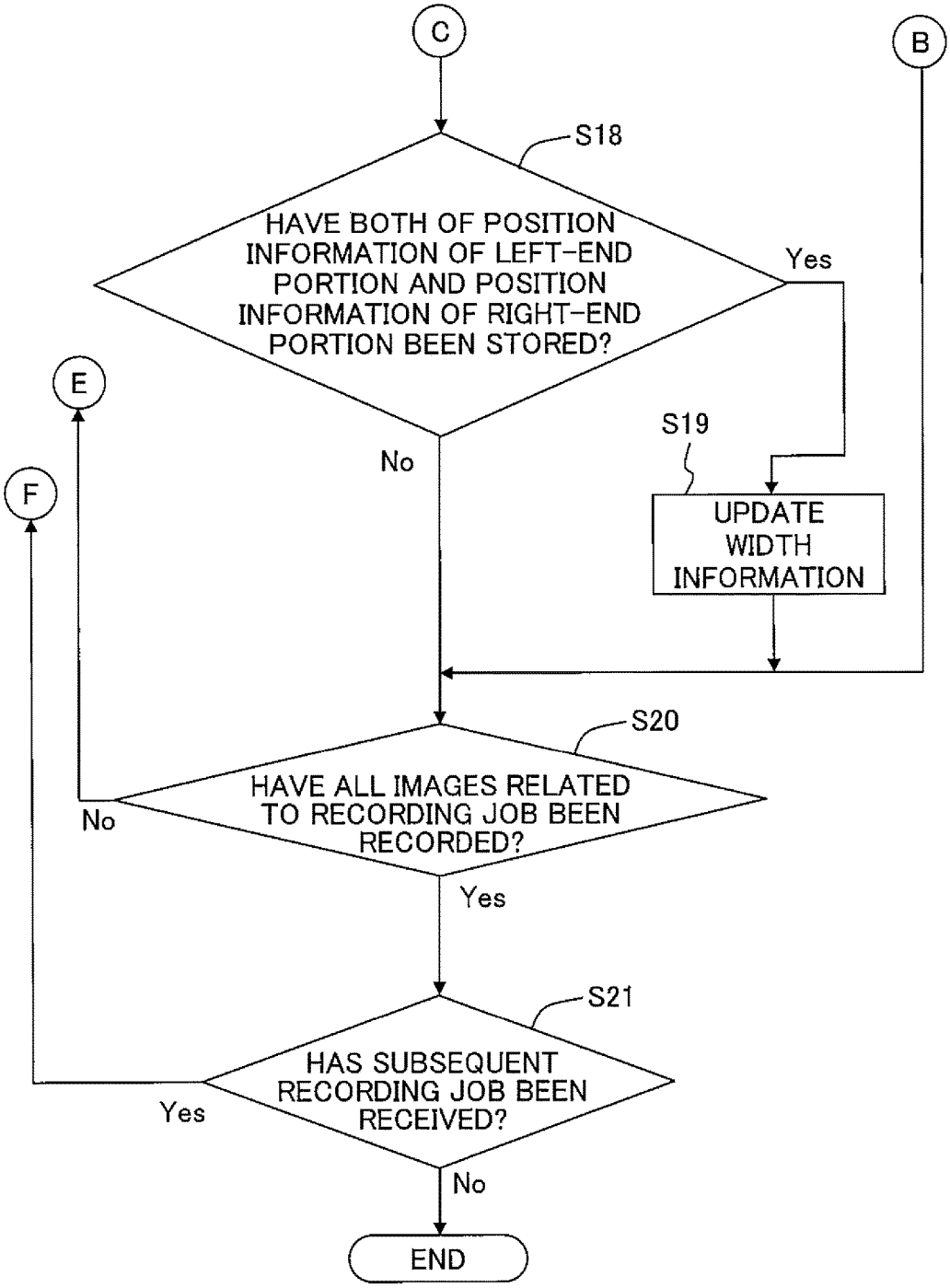

Next, an image recording operation in the printer unit 11 will be described below while referring to FIGS. 7A to 7C, FIG. 8, FIG. 9A, and FIG. 9B. In a case of recording an image on the paper P by the printer unit 11, firstly, as shown in FIG. 7A, the power supply switch 99 is pushed and the multi-function peripheral 10 is switched ON (power supply ON: step S1). At this time, the control unit 5 makes a judgment that a first predetermined condition (in other words, the multi-function peripheral 10 is switched ON) has been satisfied, and initializes the width information of the paper P and the position information of the end portions of the paper P stored in the RAM 103. As the initialization is carried out in such manner, at the time of carrying out image recording on the paper P by switching the multi-function peripheral 10 ON, it is possible to prevent the width information and the position information of the end portions, that have been stored before the multi-function peripheral 10 is switched ON, from being used. Moreover, even in a case that the paper P has been changed to a paper of different size while the multi-function peripheral 10 is switched OFF, it is possible to prevent the width information and the position information of the end portions before the initialization from being used accidentally.

Next, the control unit 5, based on the detection signal from the attachment/detachment sensor 18, judges whether or not the paper feeding tray 15 has been detached from and attached to the casing 14 (step S2). At step S2, as the detection signal indicating detachment and attachment of the paper feeding tray 15 is outputted from the attachment/detachment sensor 18 (in other words, as a detection signal indicating that the paper feeding tray 15 has been detached is outputted, and then the detection signal indicating that the paper feeding tray 15 has been attached is outputted), the control unit 5 judges that a second predetermined condition has been satisfied. In other words, the control unit 5 judges that the paper feeding tray 15 has been detached and attached by the user, and the process advances to step S3. Whereas, in a case that the detection signal is not outputted from the attachment/detachment sensor 18, the control unit 5 judges that the paper feeding tray 15 has neither been detached nor attached by the user, and the process advances to step S4. The second predetermined condition is a condition related to a size change of the paper P. This is because the user sometimes replaces the paper P in order to change the size of the paper to a different size, when the user detaches and attaches the paper feeding tray 15. At step S3, the control unit 5 initializes the width information and the position information of the end portions of the paper P stored in the ROM 103, similarly as at step S1.

At step S4, in a case that no recording job is received (NO at step S4), steps S2 and S3 are carried out repeatedly. Moreover, as the control unit 5 receives a recording job from the PC (YES at step S4), the process advances to step S5. At step S5, the control unit 5 controls the drive motor 30M and a paper P is fed from the paper feeding tray 15 by the paper feeding roller 31 up to a position where a front end of the paper P is detected by the first paper sensor 19*a*. Thereafter, at step S6, the control unit 5 judges whether or not the width information of the paper P which is being conveyed has been stored in the RAM 103. In a case that the width information of the paper P has not been stored in the RAM 103 (NO at step S6), the process advances to step S7, and in a case that the width information of the paper P has been stored in the RAM 103 (YES at step S6), the process advances to step S8. The width information of the paper P is information, of the width of the paper P being conveyed actually, that has been acquired at step S7 or step S19 to be described later, and that differs from information of paper (information of size of the paper P) included in the recording job.

Figure 8:
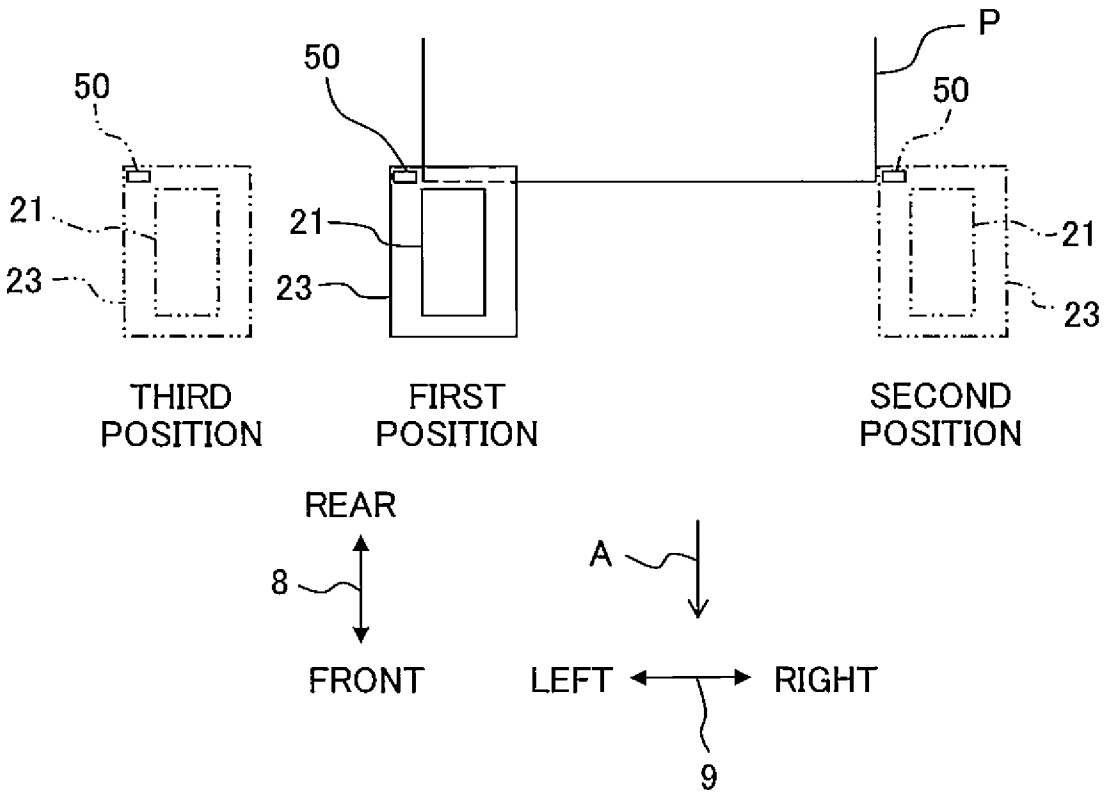
FIG. 8 is an explanatory diagram showing positions at which the width detection sensor is positioned at the time of detecting positions of end-portions.

At step S7, the control unit 5 executes acquiring processing of the width information of the paper P which is being conveyed. In other words, the control unit 5 controls the drive motor 30M, and conveys the paper P by the paper feeding roller 31 and the conveying roller pair 55 up to a position at which the front end of the paper P faces the width detection censor 50. At this time, an amount of rotation, that has been inputted to the conveying roller 55*a* after the first paper sensor 19*a* detected the paper P, is obtained as an encoder amount of the rotary encoder 57, and the paper P is conveyed such that the front end of the paper P is directly below the width detection sensor 50. As the front end of the paper P is pinched by the pair of conveying rollers 55 and the paper P is ready to be conveyed, the paper feeding roller 31 is separated from the paper P by the paper feeding arm 34, and conveying of the paper P by the paper feeding roller 31 is stopped. After this, the control unit 5 controls the carriage drive motor 40M and moves the width detection sensor 50 from a first position to a second position. In other words, as shown in FIG. 8, the control unit 5 controls the carriage drive motor 40M such that the width detection sensor 50 is arranged at a position on a right side of a right-end portion of the paper P (in other words, the second position indicated by alternate long and two short dashes line in FIG. 8) after arranging the width detection sensor 50 on a left side of a left-end portion of the paper P (in other words, the first position indicated by solid lines in FIG. 8). At this time, the control unit 5, firstly, arranges the width detection sensor 50 at the first position, based on the size of the paper P indicated by the paper information included in the recording job. Thereafter, the control unit 5 moves the width detection sensor 50 to the second position, based on the size of the paper P indicated by the paper information. A starting point (an origin) of the encoder amount in the linear encoder 35 has been set in advance. Concretely, as shown in FIG. 8, the carriage 23 is moved to a position on the extreme left side (a third position on the left side of the first position indicated by alternate long and two short dashes lines in FIG. 8) in a range of movement of the carriage 23, and by resetting the encoder amount to zero at this time, the starting point of the encoder amount of the linear encoder 35 is set. Moreover, at the time of moving the width detection sensor 50 from the first position to the second position, the width detection sensor 50 irradiates predetermined amount of light from the light emitting portion 51, and receives reflected light by the light receiving portion 52. Moreover, the AD value which is an output value of the light receiving portion 52 is stored temporarily in the RAM 103 upon being associated with the encoder amount, of the linear encoder 35, which can be position information of the carriage 23.

Detection of the end portion of the paper P is carried out in real time with respect to the AD value that is outputted sequentially from the width detection sensor 50 associated with the movement of the carriage 23. More elaborately, the AD value outputted by the width detection sensor 50 is stored temporarily in the RAM 103, and the control unit 5 detects the end portion of the paper P based on a change in an output level of the AD value. Moreover, once the left end of the paper P has been detected, the control unit 5 stores a position of the left end as position information of the left-end portion (the encoder amount of the linear encoder 35) in the RAM 103, and once the right end of the paper P has been detected, the control unit 5 stores a position of the right end as position information of the right-end portion (the encoder amount of the linear encoder 35) in the RAM 103. Based on the position information of the left-end portion and the position information of the right-end portion at this time, the control unit 5 acquires width information of the paper P (information of the width of the paper P that is conveyed practically), and stores the width information in the RAM 103. In other words, by subtracting an encoder amount of the position of the left-end portion from the starting point, from an encoder amount of the position of the right-end portion from the starting point, an encoder amount equivalent to the width information of the paper P which is being conveyed is calculated. Moreover, based on the calculated encoder amount, the width information of the paper P which is being conveyed is acquired. Thus, the width information is updated to new width information. The position information of the end portion used for updating the width information at this time is initialized.

At step S8, the control unit 5 judges whether or not a jamming of the paper P that is being conveyed occurs. In other words, in a case that, during the conveying of the paper P, the paper P is not detected by the second paper sensor 19*b* even after a predetermined time has elapsed from a timing at which the paper P was detected by the first paper sensor 19*a*, the control unit 5 judges that the third condition has been satisfied. In other words, the control unit 5 judges that the jamming of the paper P has occurred at a location such as the recording unit 20 (YES at step S8), and the process advances to step S9. Whereas, in a case that the paper P is detected by the second paper sensor 19*b* within the predetermined time from the timing at which the paper P was detected by the first paper sensor 19*a*, the control unit 5 judges that no jamming of the paper P has occurred (NO at step S8), and the process advances to step S10. Here, the predetermined time is a time necessary for conveying the paper P from the first paper sensor 19*a* up to the second paper sensor 19*b* along the conveying direction A. In such manner, the jam sensor of the present teaching is formed by the first paper sensor 19*a* and the second paper sensor 19*b*.

At step S9, the control unit 5 initializes the width information (width information) of the paper P and the position information of the end portion (end-portion position information) of the paper P stored in the RAM 103 similar to step S3. Sometimes, there is a shift in the position of the carriage 23 due to an external force which is exerted by the paper P hitting the carriage 23 or the recording head 21 when the jamming occurs, or due to an external force which is exerted by the paper or the user hitting the carriage 23 or the recording head 21 when the user removes the paper P that has caused jamming. In other words, sometimes the carriage 23 is shifted from a position indicated by the encoder amount of the linear encoder 35. Therefore, it is necessary to update the width information by resetting the starting point of the encoder amount of the linear encoder 35 once again. Before updating the width information, at step S9, the width information of the paper P and the position information of the end portion of the paper P in the RAM 103 are initialized. Hereafter, the control unit 5 notifies the user that the jamming has occurred, by a notifying means which is not shown in the diagram, and jamming-resolution process is carried out by the user. As the jamming-resolution process has been completed, the process advances to step S20. Moreover, for executing the processing at step S7 once again via step S9, the control unit 5 controls the carriage drive motor 40M and firstly moves the carriage 23 to the third position. At this time, by setting the encoder amount to zero, the starting point of the encoder amount of the linear encoder 35 is set. Thereafter, the aforementioned processing at step S7 is executed.

At steps from step S10 to step S20, the control unit 5 controls the drive motor 30M, the carriage drive motor 40M, and the recording head 21 based on the recording job and the width information, and executes the recording processing of recording images on one or more than one paper P. In the recording processing, the reciprocating movement of the carriage 32 is controlled based on the width information acquired at step S7, and at step S19 which will be described later.

Firstly, at step S10, the control unit 5 controls the drive motor 30M and conveys the paper P only by a linefeed width. Next, at step S11, the control unit 5 judges whether or not a flushing operation is to be executed. More elaborately, the control unit 5 judges whether or not the number of times of the reciprocating movements of the carriage 23 has reached a predetermined number of times (such as five times). In a case that the control unit 5 has judged that the number of reciprocating movements of the carriage 23 has reached the predetermined number of times (YES at step S11), the process advances to step S12, and in a case that the control unit 5 has judged that the number of reciprocating movements of the carriage 23 has not reached the predetermined number of times (NO at step S11), the process advances to step S13. In the present embodiment, the flushing operation is carried out in a case that the number of reciprocating movements has reached the predetermined number of times. However, the flushing operation may be carried out in a case that the number of conveyed papers P has reached a predetermined number, or in a case that a predetermined time has elapsed after the previous flushing.

At step S12, the control unit 5 controls the carriage drive motor 40M, and moves the recording head 21 to a flushing position at which the recording head 21 faces the waste-ink tray 42. Thereafter, the control unit 5 controls the recording head 21 and jets the ink from the recording head 21 toward the waste-ink tray 42. Since thickened ink in the recording head 21 is discharged in this manner, it is possible to prevent a jetting defect of the recording head 21 from occurring. Moreover, by moving the recording head 21 to the flushing position, the width detection sensor 50 is capable of detecting the left-end portion of the paper P. Therefore, position information of the left-end portion is stored in the RAM 103. In other words, it is possible to acquire the position information of the end portion of the paper P.

Figure 9A:
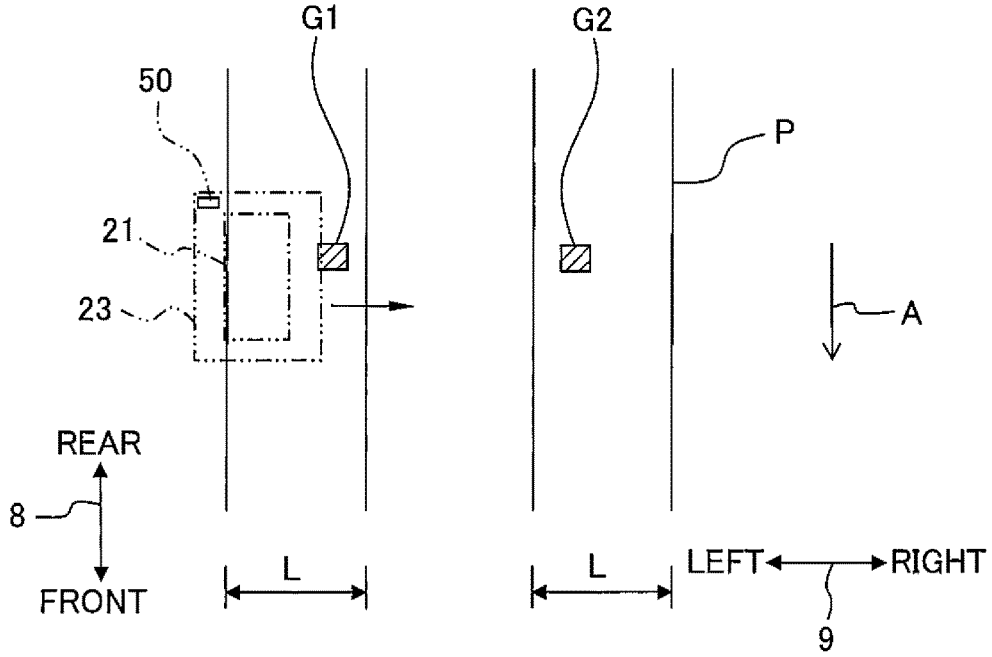
FIG. 9A and FIG. 9B are explanatory diagrams showing positions at which the width detection sensor is positioned at the time of recording an image within an end-portion area of the paper.
Figure 9B:
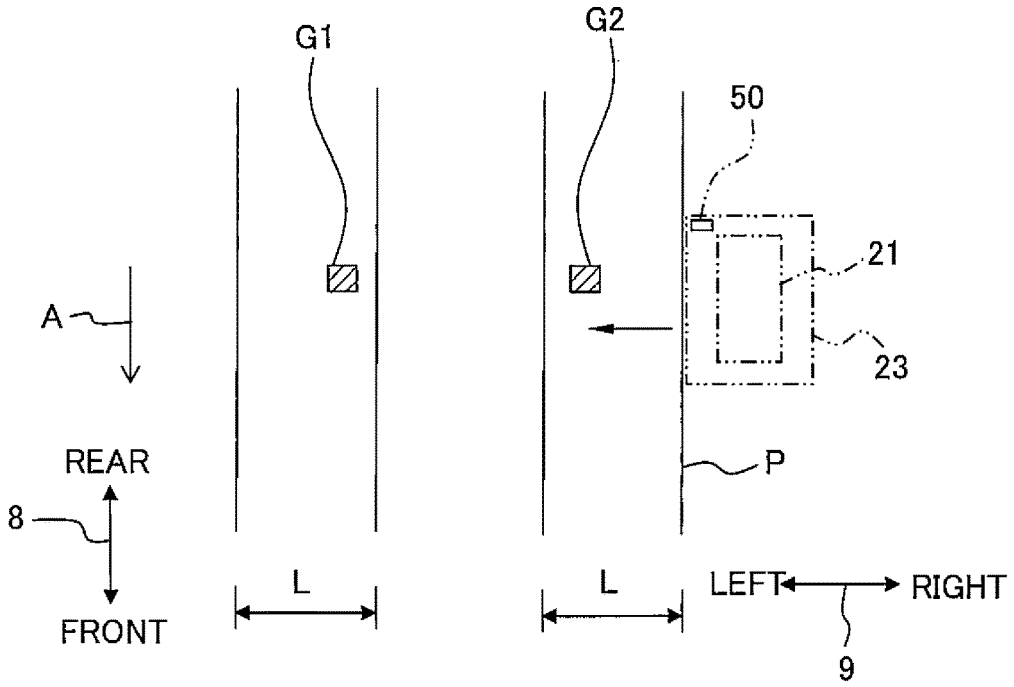

At step S13, the control unit 5 judges whether or not images indicated by image data stored in the RAM 103 are to be recorded within predetermined end-portion areas L in the left-right direction 9 of the paper P. Here, as shown in FIG. 9A and FIG. 9B, the predetermined end-portion areas L are areas on both of a left end and a right end of the paper P, and are areas each having a range shorter than half of the width in the left-right direction 9 of the paper P. As shown in FIG. 9A and FIG. 9B, in a case that the image data includes data for recording images G1 and G2 in the predetermined end-portion areas L of the paper P, the control unit 5 judges that the images are to be recorded within the predetermined end portion areas L (YES at step S13), and the process advances to step S14. Whereas, in a case that the image data does not include data for recording images in the predetermined end-portion areas L, the control unit 5 judges that the images are not to be recorded within the predetermined end portion areas L (NO at step S13), and the process advances to step S15.

At step S14, a first recording operation is carried out. In other words, the control unit 5, at the time of recording the image G1, controls the carriage drive motor 40M, and moves the recording head 21 up to a recording position of the image G1, after positioning the width detection sensor 50 temporarily on the left side of the left-end portion of the paper P (in other words, the first position indicated by alternate long and two short dashes lines in FIG. 9A). Thereafter, the control unit 5 controls the recording head 21 and records the image G1. Accordingly, at the time of recording the image G1 on the recording paper P, the width detection sensor 50 moves from the first position to a position facing the paper P, and the width detection sensor 50 is capable of detecting the position information of the left-end portion the paper P. Therefore, the position information of the left-end portion is stored in the RAM 103. Moreover, the control unit 5, at the time of recording the image G2, controls the carriage drive motor 40M, and moves the recording head 21 up to a recording position of the image G2, after positioning the width detection sensor 50 temporarily on the right side of the right-end portion of the paper P (in other words, the second position indicated by alternate long and two short dashes lines in FIG. 9B). Thereafter, the control unit 5 controls the recording head 21 and records the image G2. Accordingly, at the time of recording the image G2 on the recording paper P, the width detection sensor 50 moves from the second position to a position facing the paper P, and the width detection sensor 50 is capable of detecting the position information of the right-end portion of the paper P. Therefore, the position information of the right-end portion is stored in the RAM 103. The position information of the left-end portion and the position information of the right-end portion are stored at step S12 and step S14 respectively in the RAM 103.

At step S15, a second recording operation is carried out. In the first recording operation, the image recording is carried out after moving the width detection sensor 50 temporarily to one of the first position and the second position not facing the paper P. However, in the second recording operation, the image recording on the paper P is carried out upon moving the recording head 21 to a position facing the image recording position. In other words, the control unit 5 controls the carriage drive motor 40M and moves the recording head 21 to the image recording position at which an image is recorded, which is a position facing an area between the predetermined end-portion areas L of the paper P. Moreover, the control unit 5 controls the recording head 21 to record an image in the area between the predetermined end-portion areas L of the paper P. In this case, since the width detection sensor 50 is facing the paper P all the time, the information of positions of end portions of the paper P is not detected.

Next, at step S16, the control unit 5 judges whether or not all the images to be recorded on one paper P have been recorded. In a case that all the images have not been recorded (NO at step S16), the process returns to step S8, and aforementioned steps from step S8 up to step S16 are repeated. Whereas, in a case that all the images to be recorded on one paper P have been recorded (YES at step S16), the process advances to step S17. At step S17, the control unit 5 controls the drive motor 30M to rotate the conveying roller 55*a* and the paper discharge roller 56*a* continuously. Thus, the control unit 5 discharges the paper P to the paper discharge tray 16.

Next, at step S18, the control unit 5 judges whether or not both of the position information of the left-end portion and the position information of the right-end portion have been stored in the RAM 103 for the recording operation on one paper P. In a case that the information of positions of both end portions have been stored in the RAM 103 (YES at step S18), the process advances to step S19. Whereas, in a case that only one of the position information of the left-end portion and the position information of the right-end portion have been stored, or none of the position information of the left-end portion and the position information of the right-end portion has been stored (NO at step S18), the process advances to step S20.

At step S19, the control unit 5 executes an update processing of the width information of the paper P. In other words, the control unit 5 acquires the width information of the paper P based on the position information of the left-end portion and the position information of the right-end portion, and stores the width information in the RAM 103. In other words, the control unit 103 initializes the width information in the RAM 103 once, and stores (updates to) the acquired width information. Since the width information of the paper P is updated based on the information of the positions of the end portions of the paper P acquired during image recording, it is possible to maintain an image quality of an image recorded on the paper P while shortening the time period from receiving of the recording job to discharging the paper P on which the image has been recorded. At this time, in a case that each of the information of the position of the left-end portion and the information of the position of the right-end portion, or one of the information of the position of the left-end portion and the information of the position of the right-end portion has been stored in plurality, the width information is acquired based on an average value of the plurality of the information of the position of the end portion on the same side. Accordingly, it is possible to maintain effectively the quality of an image that is recorded on the paper P.

At step S20, the control unit 5 judges whether or not all the images involved in the recording job have been recorded on one or more than one paper P. In a case of recording on a plurality of papers for example, if the control unit 5 judges that images have not been recorded on all the papers P (NO at step S20), the process returns to step S5, and paper feeding operation for carrying out image recording on the remaining papers is carried out. In a case that the aforementioned third predetermined condition has not been satisfied (in a case that no jamming has occurred) while processing from step S5 onward is carried out, image recording is carried out on the paper P based on either the width information, in the recording job, updated at the first step S7 or updated at step S19. Moreover, processing at step S7 is a processing which is executed after a point of time at which the first to third predetermined conditions are satisfied and before an image is recorded on the first paper P based on the recording job. In other words, since the width information is initialized at step S1 and step S3, the process advances from step S6 to step S7, and the acquiring processing is executed. Moreover, even if the width information is initialized at step S9, before an image is recorded on the paper P that is re-fed (before the image is recorded on the first paper P based on the recording job), the process advances to step S7, and the acquiring processing is executed. As the images are recorded on all the papers P at step S20 (YES at step S20), the process advances to step S21.

At step S21, the control unit 5 judges whether or not the subsequent recording job has been received. In a case that the subsequent recording job has been received (YES at step S21), the process returns to step S2, and processing at steps from step S2 to step S20 similar to the aforementioned steps is executed. At this time, since the subsequent recording job has been received, the processing at step S4 is omitted. Moreover, even in a case that the aforementioned second predetermined condition (detachment and attachment of the paper feeding tray 15) and the third predetermined condition have not been satisfied while the processing at steps from step S2 onward is being executed after the subsequent job has been received, the image recording is carried out on the paper P based on the width information updated at step S7 in the previous job or the width information updated at step S19 in the previous job. In a case that the subsequent recording job has not been received at step S21 (NO at step S21), the image recording operation is finished.

As described heretofore, according to the printer unit 11 according to the present embodiment, even at the time of recording images on the plurality of papers P based on the plurality of recording jobs, after the processing at step S7 is executed for the first recording job, the width information is not updated in the acquiring processing at step S7 until the first to third predetermined conditions are satisfied. Therefore, an image is recorded on the paper P based on the width information before updating. Accordingly, it is not necessary to update the width information for each recording job, and with respect to a recording job for which updating of the width information is not required, it is possible to shorten the time period from receiving the recording job to discharging the paper P on which the image has been recorded.

Moreover, as a detection signal indicating detachment and attachment of the paper feeding tray 15 is received from the attachment/detachment sensor 18, the control unit 5 judges that the second predetermined condition has been satisfied. Thereafter, the acquiring processing at step S7 is executed. In other words, as the condition related to a change in the size of the paper P is satisfied, the acquiring processing is executed. In a case that the paper feeding tray 15 is detached and attached by the user, papers P are sometimes replaced with another paper having another size. According to the above described embodiment, even if there is a change in the size of the paper P due to replacing the paper P, it is possible to update the width information to new width information of the paper P that has been newly placed in the paper feeding tray 15. Therefore, it is possible to record an image on the P based on the width information which has been updated.

Moreover, a small backlash or gap is provided between the paper feeding tray 15 and the casing 14, so that the paper feeding tray 15 can be detached from and attached to the casing 14 smoothly. In a case that the paper feeding tray 15 is detached from and attached to the casing 14, the position of the paper feeding tray 15 with respect to the casing 14 differs between before the detachment from the casing 14 and after the attachment to the casing 14, due to the backlash. Accordingly, even if the standard size, manufacturer, and the like, of the plurality of papers P contained in the paper feeding tray 15, are the same between before the detachment from the casing 14 and after the attachment to the casing 14, the position of the paper P with respect to the conveying path 27 in the left-right direction 9 differs between before the detachment from the casing 14 and after the attachment to the casing 14. Such a position shift of the paper P in the left-right direction 9 caused by the backlash is likely to be greater than a position shift of the paper Pin the left-right direction 9 within the paper feeding tray 15. Moreover, even if the standard size of the papers P is the same, the width of the paper p slightly differs depending on the manufacturers. Therefore, in a case that the manufacturer of the plurality of papers p contained in the paper feeding tray 15 before the detachment is different from the manufacturer of the plurality of papers p contained in the paper feeding tray 15 after the attachment, the position of the paper P with respect to the conveying path 27 in the left-right direction 9 is likely to differ between before the detachment from the casing 14 and after the attachment to the casing 14. As described above, the detachment and attachment of the paper feeding tray 15 with respect to the casing 14 is likely to cause the great position shift of the paper P with respect to the conveying path 27 in the left-right direction 9. Accordingly, in the above described embodiment, the width information of the paper P is updated when the detection signal indicating the detachment and attachment of the paper feeding tray 15 is received. By doing this, it is possible to prevent the image quality from being degraded due to the great position shift of the paper P with respect to the conveying path 27 in the left-right direction 9, while shortening the time period from receiving the recording job to discharging the paper P on which the image has been recorded.

In the above described embodiment, a judgment that the second predetermined condition has been satisfied was made by detecting detachment and attachment of the paper feeding tray 15 based on the detection signal from the attachment/detachment sensor 18. However, instead of the attachment/detachment sensor 18, a number-of-sheets sensor which detects the number of papers P in the paper feeding tray 15 may be provided. In this modified example, when there is a change, in the number of sheets detected by the number-of-sheets sensor, of more than a predetermined number of sheets (more than one sheet), namely, in a case that the number of papers P in the paper feeding tray 15 has increased above or decreased below a predetermined number at a time, the control unit 5 may judge that the second predetermined condition has been fulfilled similarly as mentioned heretofore. Moreover, after the judgment has been made, the aforementioned acquiring processing at step S7 may be executed. As a case in which the number of papers P in the paper feeding tray 15 changes to more than one at a time, a case, in which the user changes the size of the paper Pin the paper feeding tray 15 to a paper P of another size, can be considered. In this modified example, in a case that the size of the paper P is changed due to replacing the paper P, it is possible to update the width information to new width information of the paper P which has been newly placed in the paper feeding tray 15, similarly as in the embodiment described above. Therefore, it is possible to record an image on the recording paper P based on the width information that has been updated. In a case of using the number-of-sheets sensor, an arrangement may be such that the paper feeding tray 15 is not detachable from the casing 14. In other words, the paper feeding tray 15 may be fixed to the casing 14. Moreover, as another modified example, without providing the attachment/detachment sensor 18 or the number-of-sheets sensor, a judgment that the predetermined condition has been fulfilled may be made based on information inputted from the user. In other words, in a case that information related to the change in the size of the paper P has been inputted by the user by operating the operating section of the multi-function peripheral 10, an arrangement may be made such that the control unit 5 judges that the second predetermined condition has been fulfilled. Thereafter, the acquiring processing at step S7 mentioned above may be carried out. Even with such arrangement, it is possible to achieve an effect similar to the effect mentioned above.

As still another modified example, in a case that the paper feeding tray 15 is configured not to be detachable from the casing 14, the control unit 5 may judge that the second predetermined condition has been satisfied when no paper P is contained in the paper feeding tray 15, similarly as aforementioned. More elaborately, in a case that the first paper sensor 19*a* does not detect the front end of the paper P until a predetermined time (time until the front end of the paper P conveyed at a predetermined conveying velocity from the paper feeding tray 15 is detected by the first paper sensor 19*a*) has elapsed after a paper-feeding start time at which the paper P is fed from the paper feeding tray 15 to the conveying path 27 by the paper feeding roller 31, the control unit 5 judges that the paper P has not been contained in the paper feeding tray 15 (in other words, the second predetermined condition has been satisfied). In a case that it is possible to detect conveying amount of the paper P by the paper feeding roller 31, if the first paper sensor 19*a* does not detect the paper P in spite of a fact that the paper feeding roller 31 rotated by an amount equivalent to an amount necessary for conveying the paper P in the paper feeding tray 15 up to a position facing the first paper sensor 19*a*, the control unit 5 may judge that the paper P has not been contained in the paper feeding tray 15. Thus, an empty-detection means of the present teaching is formed by the first paper sensor 19*a* and the control unit 5. In the present modified example, the judgment that the paper feeding tray 15 is empty is made at the aforementioned step S5, and in a case that the paper P has not been contained, initialization of the width information is carried out. Moreover, thereafter, the acquiring processing at the aforementioned step S7 may be executed. If the paper P has not been contained in the paper feeding tray 15, the user newly loads the papers P in the paper feeding tray 15. Even if the size of the papers P is changed when the papers P are loaded, it is possible to update to the width information of the papers P that have been newly loaded, similarly in the aforementioned embodiment. Therefore, it is possible to record an image on the recording paper P based on the width information that has been updated. The abovementioned modified example is also applicable to a paper feeding tray (including a manual feed tray which is provided between the paper feeding tray 15 and the first paper sensor 19*a* of the conveying path 27) which is provided separately from the paper feeding tray 15. Moreover, a sensor which is capable of inputting a signal, directly to the control unit 5, that indicates that the paper P has not been contained in the paper feeing tray 15 may be provided to the paper feeding tray 15. In this case, the control unit 5 may judge that the second predetermined condition has been fulfilled based on the signal (the signal which indicates that no paper P has not been contained) inputted from the sensor. Even in this case, it is possible to achieve an effect similar to the abovementioned effect.

Moreover, when jamming of the paper P occurs in the conveying path 27, the control unit 5 judges that the third predetermined condition has been satisfied. Therefore, when the jamming occurred, the acquiring processing is carried out. Moreover, when the power supply is put ON, the control unit 5 judges that the first predetermined condition has been satisfied. Accordingly, even if the user replaces the papers P when the power supply is OFF, because the width information is updated to that of the replaced paper P, it is possible to record an image on the recording paper P based on the updated width information.

Moreover, in a case that the image G1 (or the image G2) is to be recorded in the predetermined end-portion area L, the control unit 5 controls the carriage drive motor 40M such that the width detection sensor 50 is arranged at the first position (or the second position). Accordingly, it becomes easy to achieve the information of positions of the end portions of the paper P. Therefore, it is possible to maintain, more effectively, the quality of the image recorded on the recording paper P.

The embodiments of the present teaching have been described heretofore. However, the present teaching is not restricted to the embodiments described heretofore, and various modifications without departing from the claims described are possible. For instance, in the aforementioned embodiments, the width information of the paper P acquired at step S7 and step S19 was stored in the RAM 103. However, the width information of the paper P may be stored in another storage unit such as a flash memory. Moreover, even when an image is to be recorded in the end-portion area L, the recording head 21 may be moved to a recording position at which the image is to be recorded, without being moved to the first position or to the second position. Even in this case, when the width detection sensor 50 is moved to a position at which the width detection sensor 50 can detect the end portions of the paper P, the information of the positions of the end portions detected by the width detection sensor 50 may be stored in the RAM 103. Moreover, in the recording operation of recording an image on a paper P, even if the width detection sensor 50 detects the information of the positions of the end portions, the information of the positions of the end portions detected by the width detection sensor 50 may not be stored in the RAM 103. Moreover, only one of the first to third predetermined conditions mentioned above may be adopted, and when that predetermined condition has been satisfied, updating of the width information may be carried out after initializing the width information. Moreover, the width information to be updated may be overwritten without initializing.

Moreover, the moving mechanism 40 may move the carriage 23 together with the recording head 21 in an intersecting direction which is slightly inclined from a direction orthogonal to the conveying direction A. In this case, the width information of the paper P in the intersecting direction is to be acquired. Moreover, it may be any conveying mechanism (such as a belt conveying mechanism) provided that the conveying mechanism is capable of conveying the paper P in the conveying direction A.

Examples, in which the present teaching is applied to a recording apparatus for recording an image by jetting inks from the nozzles, have heretofore been described. However, the present teaching is also applicable to a recording apparatus other than printer, which jets liquids other than ink from the nozzles.

What is claimed is:

1. A recording apparatus comprising:

a conveyor configured to convey a recording medium in a first direction;

a recording head configured to record an image on the recording medium;

a carriage supporting the recording head;

a moving mechanism configured to move the carriage reciprocatingly together with the recording head in a second direction intersecting the first direction;

a width detection sensor installed in the carriage on an upstream side of the recording head in the first direction, the width detection sensor configured to detect two ends of the recording medium in the second direction;

a medium detection sensor disposed on an upstream side of the carriage in the first direction to face the recording medium conveyed in the first direction by the conveyor, the medium detection sensor configured to detect the recording medium conveyed in the first direction by the conveyor;

a memory configured to store width information relating to the second direction of the recording medium conveyed in the first direction by the conveyor;

a tray configured to contain the recording medium to be conveyed in the first direction by the conveyor; and a controller configured to control the conveyor, the recording head and the moving mechanism to record an image on at least one recording medium based on the width information and a recording job which is a series of processing corresponding to a recording command, and configured to determine whether a predetermined condition for updating the width information is satisfied, wherein the controller is configured to determine whether the tray is empty based on a detection result by the medium detection sensor, and after determining that the tray is empty and before recording of an image on a first recording medium based on the recording job, the controller is configured to:

acquire width information of the first recording medium by detecting the two ends of the first recording medium in the second direction by the width detection sensor; and store the width information of the first recording medium, which has been acquired, in the memory until the controller determines that the predetermined condition has been satisfied.

2. The recording apparatus according to claim 1, wherein based on determining that the tray is empty, the controller determines that the predetermined condition has been satisfied, and the controller determines that the tray is empty, under a condition that the medium detection sensor does not detect the recording medium for a predetermined time since a conveyance-start time to start conveyance of the recording medium from the tray.

3. The recording apparatus according to claim 1, wherein based on determining that the tray is empty, the controller determines that the predetermined condition has been satisfied, and the controller determines that the tray is empty, under a condition that the medium detection sensor does not detect the recording medium after the conveyor is driven by a predetermined amount corresponding to a conveyance amount of the recording medium from the tray to the medium detection sensor.

4. The recording apparatus according to claim 2, wherein the controller determines that the tray is empty, under a condition that the medium detection sensor does not detect a leading end in the first direction of the recording medium for the predetermined time since the conveyance-start time.

5. The recording apparatus according to claim 1, wherein the memory is configured to further store end-portion position information acquired by detecting an end portion of the recording medium in the second direction by the width detection sensor, and in a case that end-portion position information of each of the two ends of the recording medium in the second direction has been stored in the memory for one recording job, even if the controller determines that the predetermined condition has not been satisfied, the controller is configured to:

acquire new width information of the recording medium based on the end-portion position information of each of the two ends; and update the width information that has been stored in the memory with the new width information that has been acquired.

6. The recording apparatus according to claim 5, wherein in a case that a plurality of end-portion position information of one side of the recording medium in the second direction is stored in the memory, even if the controller determines that the predetermined condition has not been satisfied, the controller is configured to:

acquire the new width information of the recording medium based on the end-portion position information of the other side of the recording medium in the second direction and an average value of the plurality of end-portion position information of the one side of the recording medium in the second direction; and update the width information that has been stored in the memory with the new width information that has been acquired.

7. The recording apparatus according to claim 5, wherein in a case that recording data for recording an image in an end-portion area of the recording medium is included in the recording job, the controller is configured to:

control the moving mechanism to move the width detection sensor to a position at which the width detection sensor detects the end portion of the recording medium which is nearest to the end-portion area under a condition that the image according to the recording data is recorded on the recording medium; and acquire the end-portion position information by detecting the end portion of the recording medium in the second direction by the width detection sensor.

8. The recording apparatus according to claim 1, wherein the controller is configured to initialize the width information stored in the memory, after the controller determined that the predetermined condition has been satisfied.

9. The recording apparatus according to claim 1, further comprising a casing in which the conveyor, the recording head, the carriage, the moving mechanism, the width detection sensor, the medium detection sensor, the tray, and a conveying path for the recording medium are provided, wherein the conveyor conveys the recording medium in the first direction along the conveying path, and the medium detection sensor is provided for the conveying path.

* * * * *